United States Patent [19]

Meijer et al.

[11] Patent Number: 4,996,841

[45] Date of Patent: Mar. 5, 1991

[54] STIRLING CYCLE HEAT PUMP FOR HEATING AND/OR COOLING SYSTEMS

[75] Inventors: Roelf J. Meijer; Kaveh Khalili, both of Ann Arbor; Ernst Meijer, Saline; Ted M. Godett, Ann Arbor, all of Mich.

[73] Assignee: Stirling Thermal Motors, Inc., Ann Arbor, Mich.

[21] Appl. No.: 388,689

[22] Filed: Aug. 2, 1989

[51] Int. Cl.[5] ..... F02G 1/04

[52] U.S. Cl. ..... 60/525; 60/517; 62/6

[58] Field of Search ..... 60/517, 518, 525; 62/6, 62/325; 165/42

[56] References Cited

U.S. PATENT DOCUMENTS

| | | | |
|---|---|---|---|
| 3,858,802 | 1/1975 | Stobart | 62/6 X |
| 4,439,169 | 3/1984 | Meijer et al. | 464/170 |
| 4,462,212 | 7/1984 | Knoos | 62/6 X |
| 4,481,771 | 11/1984 | Meijer et al. | 60/517 |
| 4,680,478 | 7/1987 | Wicks | 290/2 |

*Primary Examiner*—Stephen F. Husar

*Attorney, Agent, or Firm*—Harness, Dickey & Pierce

[57] ABSTRACT

Stirling cycle heat engine adapted for use as space heating and/or air conditioners. One embodiment features a Stirling engine prime mover providing a hybrid Stirling machine. Another embodiment utilizes an electric drive motor as a prime mover and a final embodiment is an open drive Stirling thermal engine particularly adapted for automotive belt driven applications. Enhancements in performance are provided by using pressure ratios significantly lower than that ordinarily provided for Stirling cycle engines. Decreases in pressure ratios are provided by intentionally adding dead volume to the cycle and particularly adding this dead volume strategically in the regenerator of the device which has been found to provide performance benefits. The systems according to this invention can be used either as space heaters or air conditioners by appropriately directing heat absorbed and rejected from the heat exchangers of the device to the approrpriate environment.

35 Claims, 8 Drawing Sheets

STIRLING CYCLE HEAT PUMP FOR HEATING AND/OR COOLING SYSTEMS

BACKGROUND AND SUMMARY OF THE INVENTION

This invention is related to systems for space heating and/or cooling using Stirling cycle machines and particularly to improvements in the configuration, construction and operation of such devices.

Many cooling and heating systems presently used for temperature control of structures such as buildings or homes, and for cooling in motor vehicles principally rely on Freon (trademark for R-12 and R-22 refrigerants) as a working fluid. Although such systems operate in a reliable and efficient manner, their use is drawing increasing criticism since release of the refrigerant into the atmosphere during use or upon dismantling of the system has been shown to cause serious damage to the earth's ozone layer. The United States Government has enacted laws to eliminate or sharply curtail the use of chlorinated fluorocarbons (CFC) such as Freon and other gases harmful to the earth's ozone layer. Since destruction of the ozone layer has global implications, many of the industrialized countries of the world are cooperating in proposing and enacting laws to curtail the use of ozone damaging materials. In view of this situation, there is serious interest in providing thermal cycle systems for heating and cooling which use non-hazardous working mediums.

One type of thermal machine capable of providing space heating and cooling which can use non-polluting gases such as helium or hydrogen is the Stirling cycle machine. The Stirling cycle is a closed reversible thermodynamic cycle which can be implemented as a prime mover where heat is supplied and the output is in the form of mechanical power, as a refrigerator where mechanical power is supplied and the output is cooling capacity, or as a heat pump in which mechanical power is supplied and the output is in the form of heat (or in a reverse mode, cooling capacity). The assignee of this invention, Stirling Thermal Motors, Inc., is in the forefront of Stirling machine technology and has made numerous inventions in the art including those described by U.S. Pat. Nos. 4,579,046, 4,615,261, 4,669,736, and 4,707,990, which are incorporated herein by reference, and in current pending patent applications.

In accordance with conventional design practices for Stirling cycle devices, it was assumed that the Stirling cycle for so-called small temperature lifts (e.g., 10° C.), such as for cooling and heating of spaces, was not suitable because of the low coefficient of performance (COP) provided by such a cycle. The reason for such low COP is that the adiabatic temperature fluctuations are large compared to the main temperature difference between the expansion heat exchanger and the compression heat exchanger of the device. The best method of obtaining high COP with a Stirling cycle would be to provide truly isothermal compression and expansion of the working medium. Attempts to provide isothermal compression and expansion with the Stirling cycle have not been successful to date. One approach to approaching isothermal compression or expansion is to reduce the pressure ratio of the machine (defined as the maximum divided by the minimum working fluid pressures in the compression space). However, by reducing the pressure ratio, the thermal output of the machine is also reduced. In view of these factors, Stirling cycle machines have not been viewed as good candidates to replace existing vapor compression heat pump and/or air conditioning systems.

In accordance with this invention, a Stirling cycle machine is provided which has an enhanced level of performance for space heating and cooling applications. The enhancements in performance are attributable in part to operating the device at low pressure ratio conditions where isothermal compression and expansion is approached. To compensate for the reduced thermal output of such a machine, it is charged with a working fluid at an unusually high mean pressure for this application. An excess so-called "dead volume" of the machine is intentionally incorporated for the purpose of decreasing its pressure ratio and increasing Coefficient of Performance (COP). The dead volume is optimally provided in the regenerator element of the Stirling machine since that element operates in a nearly isothermal fashion and putting it there results in lower friction losses when the machine is designed for low temperature lifts.

In accordance with a first embodiment of the present invention, a Stirling cycle heat pump/air conditioner is provided which is a "duplex" machine, having a Stirling cycle engine powered by a heat input such as by a direct gas flame which drives a Stirling cycle heat pump which provides a thermal output. The high mean pressure operation of the Stirling cycle heat pump/air conditioner operating at a relatively low pressure ratio provides the advantage that it can match the mean pressure used in the driving Stirling engine, thus allowing a common crankcase to be used. This embodiment features a Stirling engine substantially identical to those described in accordance with previously issued U. S. patents and currently pending applications assigned to Stirling Thermal Motors, with the addition of a piston for the Stirling heat pump/air conditioner coupled directly to the engine swashplate. For heating of a building during winter, the expansion heat exchanger absorbs heat from an outdoor heat exchanger coil and the compression heat exchanger rejects heat via an indoor heat exchanger coil. For summer air conditioning, valves could be used to reverse the heat exchangers which the expansion and compression space heat exchangers are connected to, causing indoor heat to be absorbed and rejected outside.

In a second embodiment of this invention, a Stirling cycle heat pump/air conditioner is driven by an electric motor enclosed within the pressure hull of the machine. This embodiment features the same enhancements in terms of reduced pressure ratio and excess dead volume placement. This device can be switched between summer cooling and winter heating modes in either of two manners. In one approach, the indoor and outdoor heat exchanging coils can be exchanged between the heat exchangers of the machine using valves or other circuit routing switches as in the first embodiment. Alternatively, the direction of rotation of the driving electric motor can be reversed which has the effect of changing the expansion heat exchanger to become the compression heat exchanger, and vice versa. This approach provides dual mode operation without complicated plumbing and valves.

The third embodiment of this invention is an open drive device principally adapted to provide air conditioning for motor vehicles. The device could be powered by a belt driven off the engine crankshaft. In addition to operating as an air conditioner, the unit is also capable of rapidly warming up the compartment of the vehicle even before the engine coolant becomes warm enough for compartment heating.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
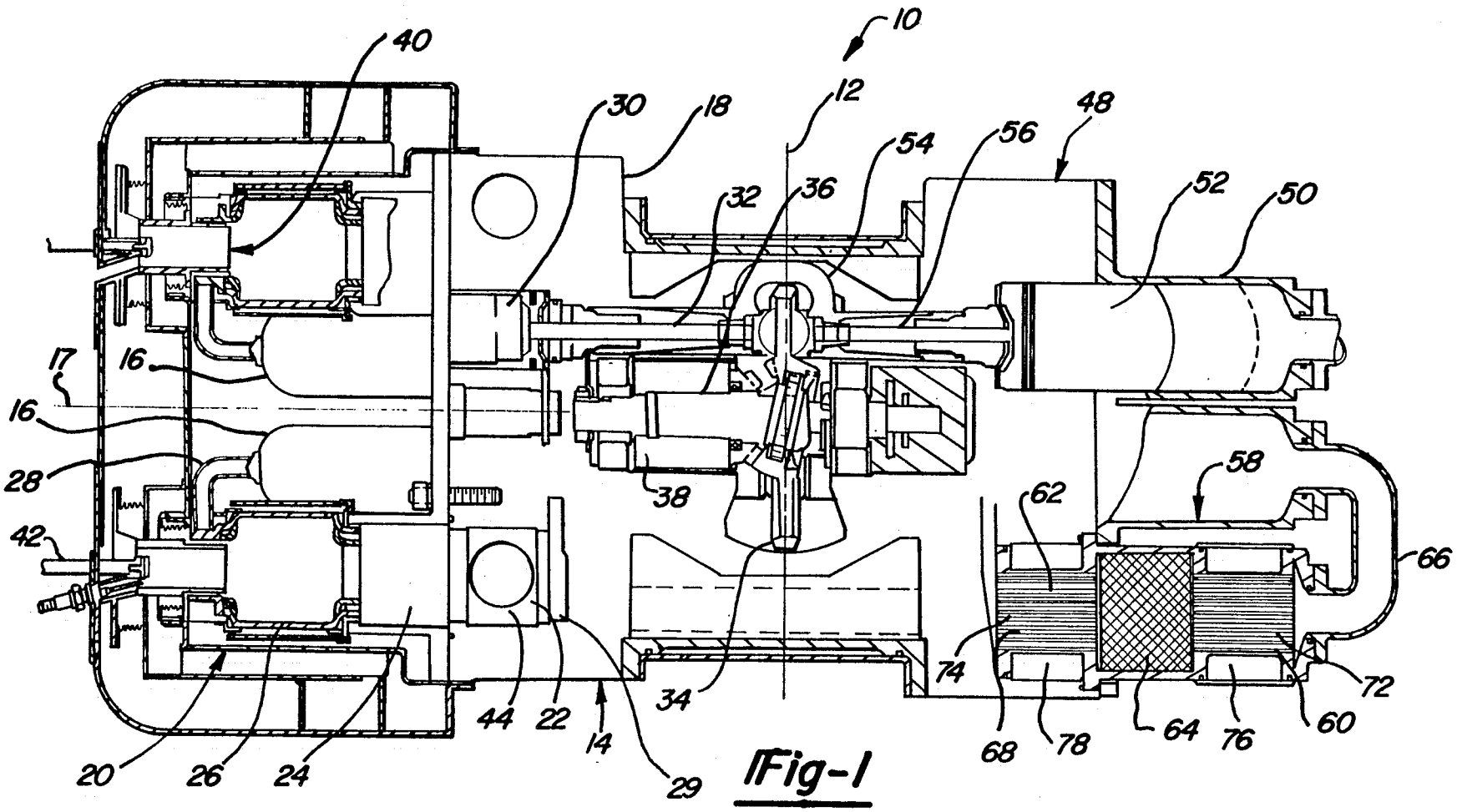
FIG. 1 is a cross-sectional view of a duplex Stirling heat pump/air conditioner in accordance with a first embodiment of this invention.

A duplex Stirling machine for use in a heat pump/air conditioner system in accordance with a first embodiment of this invention is shown in FIG. 1 and is generally designated there by reference number 10. Stirling machine 10 is a combination of two separate Stirling machines which are joined together generally at midplane 12. To the left of midplane 12 is a Stirling engine 14 which could be powered by any available source of heat. In the embodiment of FIG. 1, a combustible gas directly heats a heat exchanger of the engine. Engine 14 is substantially identical to the machine described in copending U.S. Patent Application Ser. No. 341,424, filed April 21, 1989 and hereby incorporated by reference. Stirling engine 14 includes four substantially parallel piston cylinders 16 which are disposed in a square cluster about a central axis 17 within housing 18. Associated with each piston cylinder 16 and located on an end surface of housing 18 is a heat transfer stack 20 comprising cooler 22, regenerator 24 and heat exchanger 26. These elements of stack 20 are arranged end-to-end to form a cylindrical column which communicates with the top end of piston cylinder 16 via hot connecting duct 28. A cold connecting duct 29 is connected to the bottom end of an adjacent piston cylinder 16. Engine 14 is of the double acting type in which the top of each cylinder is the expansion space and the bottom defines the compression space. Various numbers of cylinders for engine 14 could be provided, however, at least three cylinders are needed for double acting operation. The expansion spaces of each cylinder are connected to the compression spaces of adjacent cylinders through stack 20.

Movable within each cylinder 16 is piston 30 attached to connecting rod 32. Swashplate 34 converts the reciprocating motion of pistons 30 into rotation of the swash plate. The embodiment shown includes a variable angle swashplate in which the angle of the plane of the swashplate can be varied. The angle of the swashplate defines the stroke of the pistons and by rotating it relative to shaft 36 varies the swashplate angle and the piston strokes to control the output of the engine. This rotation is effected by stroke converter 38. Heat is inputted to Stirling engine 14 through combustor assemblies 40 associated with each of heat exchangers 26. A combustible gas is introduced through gas injectors 42, mixed with preheated air, and combusted within heat exchanger 26. Cooler 22 has a jacket 44 of cooling water surrounding it. Additional details of the operation of Stirling engine 14 can be obtained by reference to issued U.S. Pat. No. 4,481,771 and pending application Ser. No. 341,424 which are hereby incorporated by reference and are assigned to the assignee of this invention.

On the right-hand side of machine midplane 12 is Stirling heat pump/air conditioner 48 having four cylinders 50 with pistons 52 therein which are arranged in coaxial alignment with engine cylinders 16. This orientation is especially convenient and efficient since crossheads 54 which couple connecting rods 32 to swashplate 34 ar also directly coupled to pistons 52 by connecting rods 56. Also similar in configuration to engine 14, heat pump/air conditioner 48 includes four heat transfer stacks 58 which are arranged in column form and including expansion heat exchanger 60, compression heat exchanger 62 with regenerator 64 therebetween. Like engine 14, heat pump/air conditioner 48 is a double acting machine in that compression heat exchanger 62 communicate with one end of one adjacent cylinder 50 and expansion heat exchanger 60 communicates with the opposite end of another adjacent cylinder 50. Cylinder 50 communicates with expansion heat exchanger 60 via expansion space connecting duct 66 whereas compression space heat exchanger 62 communicates with the adjacent cylinder via compression space connecting duct 68. Heat exchangers 60 and 62 are comprised of a cross-flow heat exchanger such as a bundle of tubes 72 and 74, which are surrounded by liquid jackets 76 and 78, respectively.

For maximum efficiency, it is desirable for the relatively "cooler" expansion heat exchanger 60 to be the furthest from swashplate 34 since heat from mechanical friction losses and lubricating oil in the crankcase area constitute a greater thermal loss to the cycle if it is absorbed by the relatively cooler heat exchanger. In order to provide such operation, the direction of connecting ducts 66 are reversed from those of connecting ducts 28. In an end view of machine 10 of the left hand side of FIG. 1, hot connecting ducts 28 extending between cylinder 16 and stacks 20 would be seen oriented in a rotation direction, for example, clockwise. If one were to examine machine 1 at its other end from an end view perspective, expansion space connecting ducts 68 would be seen oriented in a counterclockwise direction. This insures that the expansion heat exchanger 60 is at the end of the machine.

Figure 2:
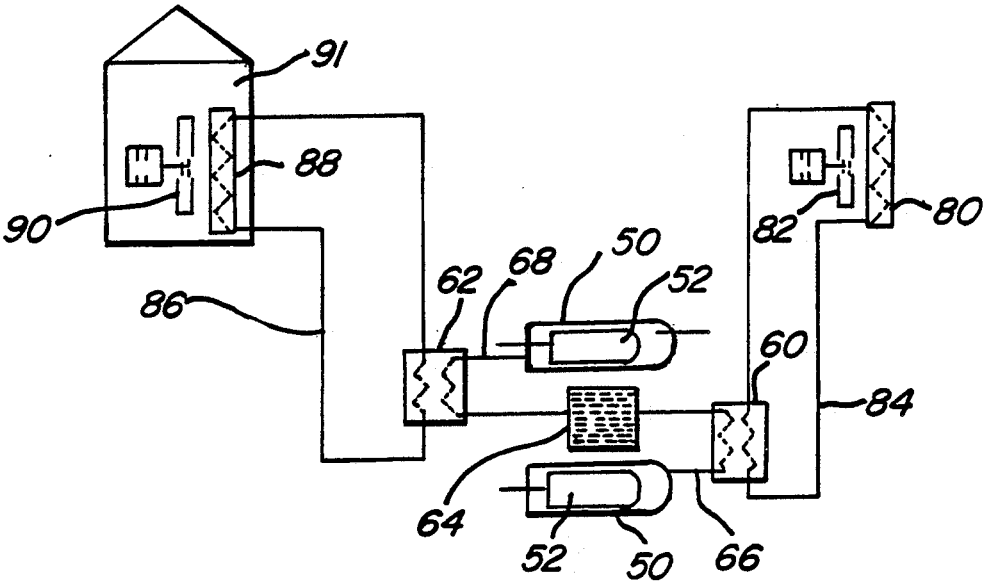
FIG. 2 is a diagrammatic view of a heat pump system incorporating the Stirling machine shown in FIG. 1.

Irrespective of whether heat pump/air conditioner 48 is operated in a heat pump or air conditioning mode, heat is absorbed at expansion heat exchanger 60 and rejected from compression heat exchanger 62. With reference to FIG. 2, a heat pump system is illustrated in diagrammatic form incorporating Stirling heat pump/air conditioner unit 48 operating in a heat pump mode. This figure illustrates a pair of cylinders 50 with reciprocating pistons 52 which communicate with expansion heat exchanger 60 and compression heat exchanger 62 with regenerator 64 therebetween. In operation, heat is absorbed at expansion heat exchanger 60 from outdoor coil 80 with fan 82 to promote heat transfer. A closed circuit of heat transfer fluid circulates within the outdoor coil loop 84. Compression heat exchanger 62 heats a fluid circulating within indoor coil loop 86 which includes indoor coil 88 and fan 90 situated inside building 91.

Figure 3:
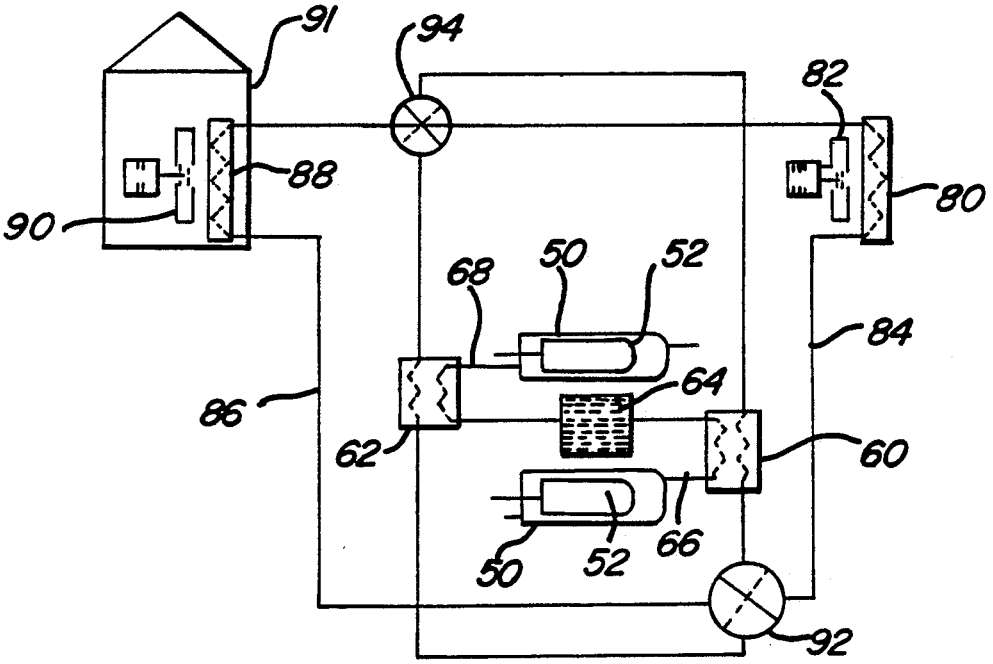
FIG. 3 is a diagrammatic view of the Stirling machine shown in FIG. 1 used in a dual mode heat pump/air conditioning system.

FIG. 3 illustrates a space heating and cooling system utilizing Stirling heat pump/air conditioner 48. For this system, a pair of valves 92 and 94 are employed to selectively enable expansion heat exchanger 60 and compression heat exchanger 62 to be in a fluid circuit with either outdoor or indoor coil 80 or 88. As shown in FIG. 3, when operating in a heat pump mode, valves 92 and 94 would be in the position shown in full lines in FIG. 3 in which expansion heat exchanger 60 communicates with outdoor coil 80 and compression space heat exchanger 62 communicates with indoor coil 88. In air conditioning conditions where it is desired to cool building 91, valves 92 and 94 are actuated to the phantom line position shown in FIG. 3. In that condition, expansion heat exchanger 60 and compression heat exchanger 62 communicate with indoor coil 88 and outdoor coil 80, respectively.

Since Stirling engine 14 cannot deliver full power output until heat exchanger 26 reach operating temperatures, swashplate 34 would initially be positioned to provide a small stroke. This reduces initial startup torque. When full power output is achieved, the stroke provided by swashplate 34 can be changed to match the thermal output required in a particular operating condition of the machine.

As will be more fully developed in the following sections, Stirling heat pump/air conditioner 48 uses a relatively low pressure ratio which requires a high mean pressure for the working medium which could typically be helium or hydrogen. This high mean pressure makes the device especially adaptable for a duplex type machine application since Stirling engine 14 is quite suitable for high pressure operation. One design of such a duplex design would feature a mean pressure of hydrogen gas of about 110 atmospheres. Use of the same mean pressures for both engine 14 and heat pump/air conditioner 48 provides the significant benefit that the devices can share a single crankcase.

In duplex machine 10, both engine 14 and heat pump/air conditioner operate at the same mean pressure, at the same speed and stroke, and use the same working fluid. In order to optimize the system, it was found necessary to provide pistons 52 of the heat pump/air conditioner of a larger diameter than pistons 30 of engine 14. Therefore, the swept volume of pistons 52 is greater than that of pistons 30. In one example of a machine according to this invention, engine pistons 30 each have a swept volume of 25 cc. whereas the pistons 52 each have a swept volume of 55 cc.

Figure 4:
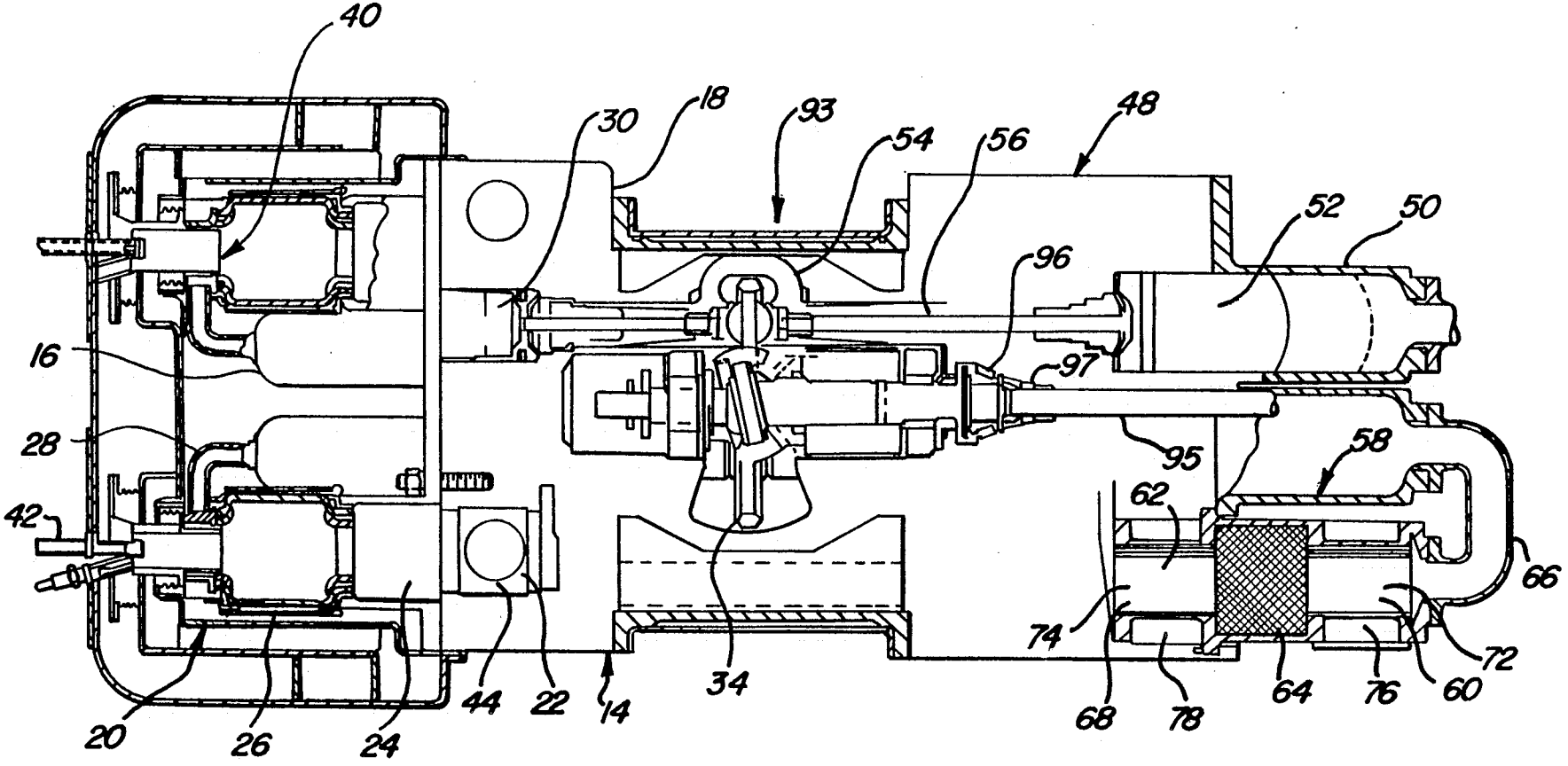
FIG. 4 is a cross-sectional view of a duplex machine like that shown in FIG. 1 but having an external power take off shaft.

FIG. 4 illustrates duplex machine 93 which is substantially identical to machine 10, except that it incorporates an external power take-off shaft 95. Elements of machine 93 identical to those of machine 10 are identified by like reference numbers. Shaft 95 is connected to swashplate shaft 36, and is supported by bearing 96. Seal 97 prevents leakage of the working fluid and lubricants. Shaft 95 permits machine 93 to be started by an auxiliary power source. Shaft 97 can also be used to deliver mechanical energy to an external load such as an electrical alternator or generator. This capability enables machine 93 to be used in a cogeneration system which allows electricity to be generated at a home or building, providing inherent efficiencies over exclusive reliance on large central generating stations with the significant transmission losses encountered in disturbing their power.

Figure 5:
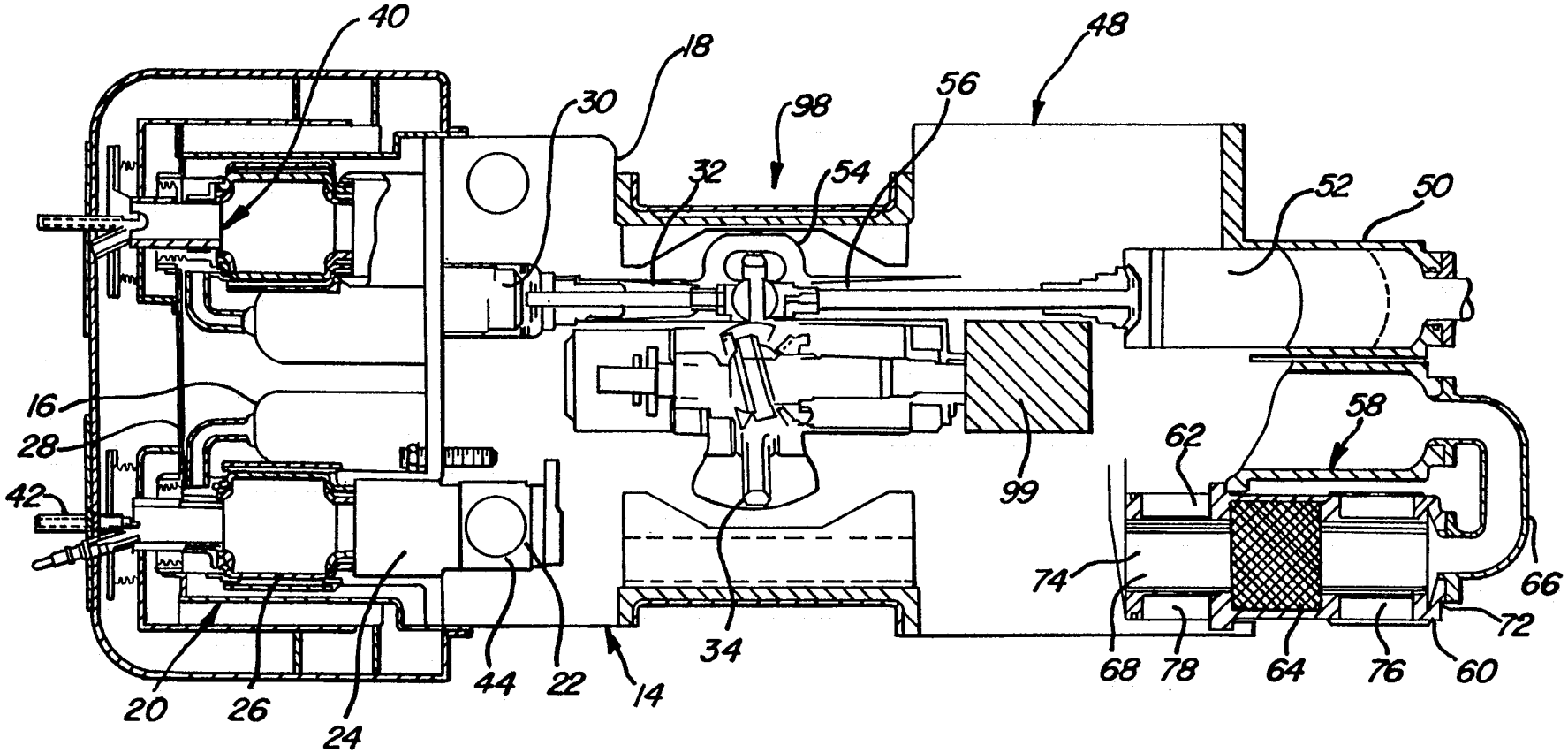
FIG. 5 is a cross-sectional view of a duplex machine like that shown in FIG. 1 but having an internal starter motor/generator.

In FIG. 5, another variation of duplex machine 10 is shown. Machine 98 includes an internal motor 99 connected directly to swashplate shaft 36. Motor 99 enables the machine to be started and can also be driven as a generator or alternator to deliver electricity. Thus, machine 99 can be used as a cogeneration system like machine 93 with its attendant advantages.

Figure 6:
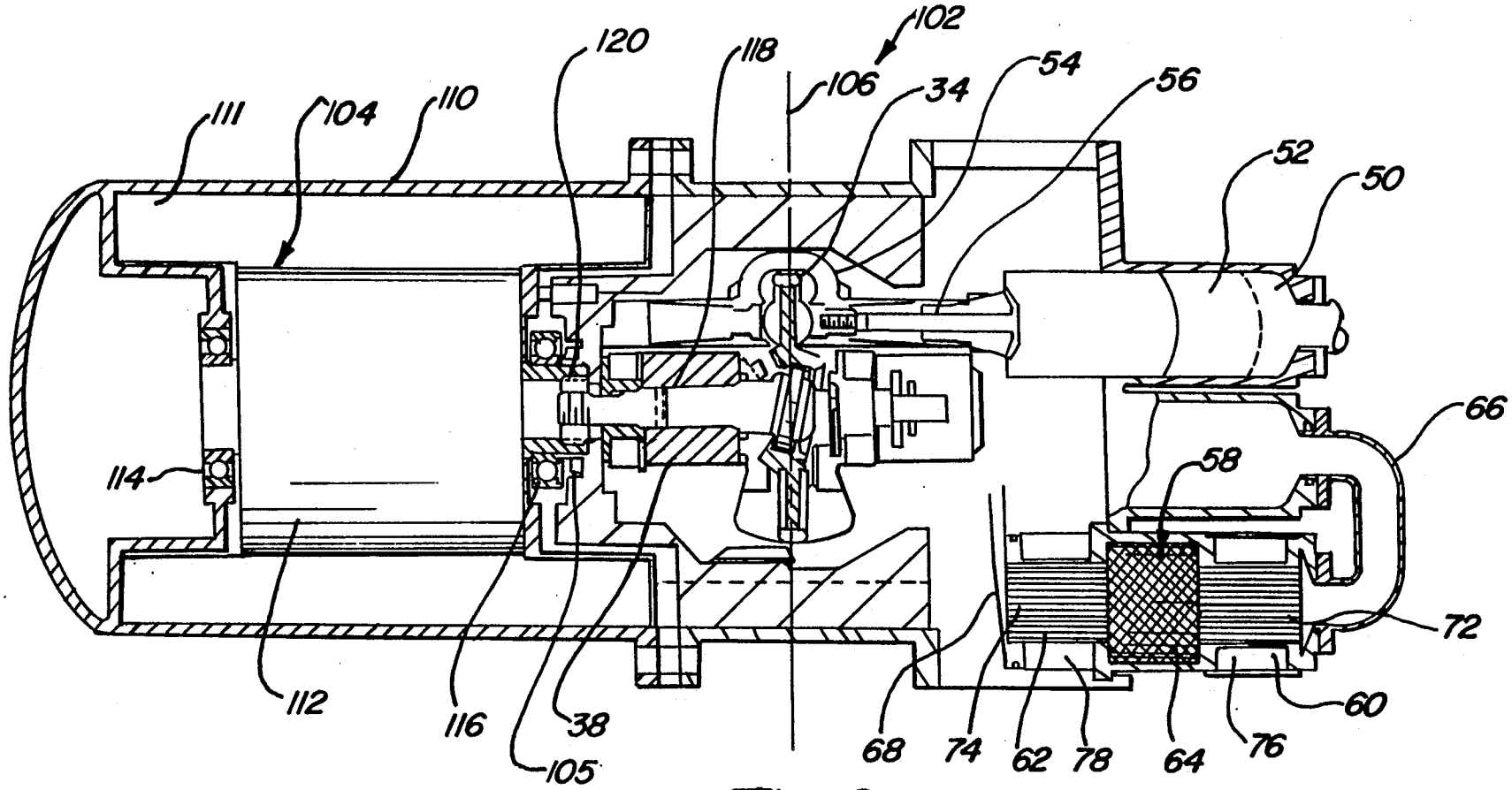
FIG. 6 is a cross-sectional view of a Stirling heat pump/air conditioner in accordance with a second embodiment of this invention utilizing an electric drive motor.

Now with reference to FIG. 6, a Stirling heat pump/air conditioner according to a second embodiment of this invention is shown which is generally designated by reference number 102. Machine 102 differs from machine 10 in that an electric induction motor 104 is used as a prime mover. The motor is shown as an induction motor although various types of electric motors could be used. The components to the right of midplane 106 are substantially identical to elements described in connection with the previous embodiment 48. Accordingly, those common elements are identified by like reference numbers and a description of these elements is not necessary. For this embodiment, induction motor 104 is sealed within pressure hull 110 and consists of a stator 111 and rotor 112 which is supported at its axial ends by bearing assemblies 114 and 116. Oil lip seal 105 keeps oil from contaminating the generator. Rotor 112 is connected to shaft 118 through spline connection 120 which accommodates a small degree of misalignment between the shafts without causing binding. Machine 102 is also shown with a variable stroke swashplate mechanism 34 which provides low starting torque and further enables the output of the device to closely match the thermal requirements of a particular operating mode.

If electric induction motor 104 is of a type which can be operated in both rotational directions, machine 102 can be operated in both the heat pump and air conditioning modes simply by reversing the direction of rotation without resorting to the use of valves as described in connection with FIG. 3. Upon a reversal in direction of rotation of the motor, the expansion heat exchanger will operate as the compression heat exchanger and vice versa. Due to the relatively small differences in operating temperatures of the two heat exchangers, they can be made of identical components and can thus be used to operate efficiently in either mode.

Figure 7:
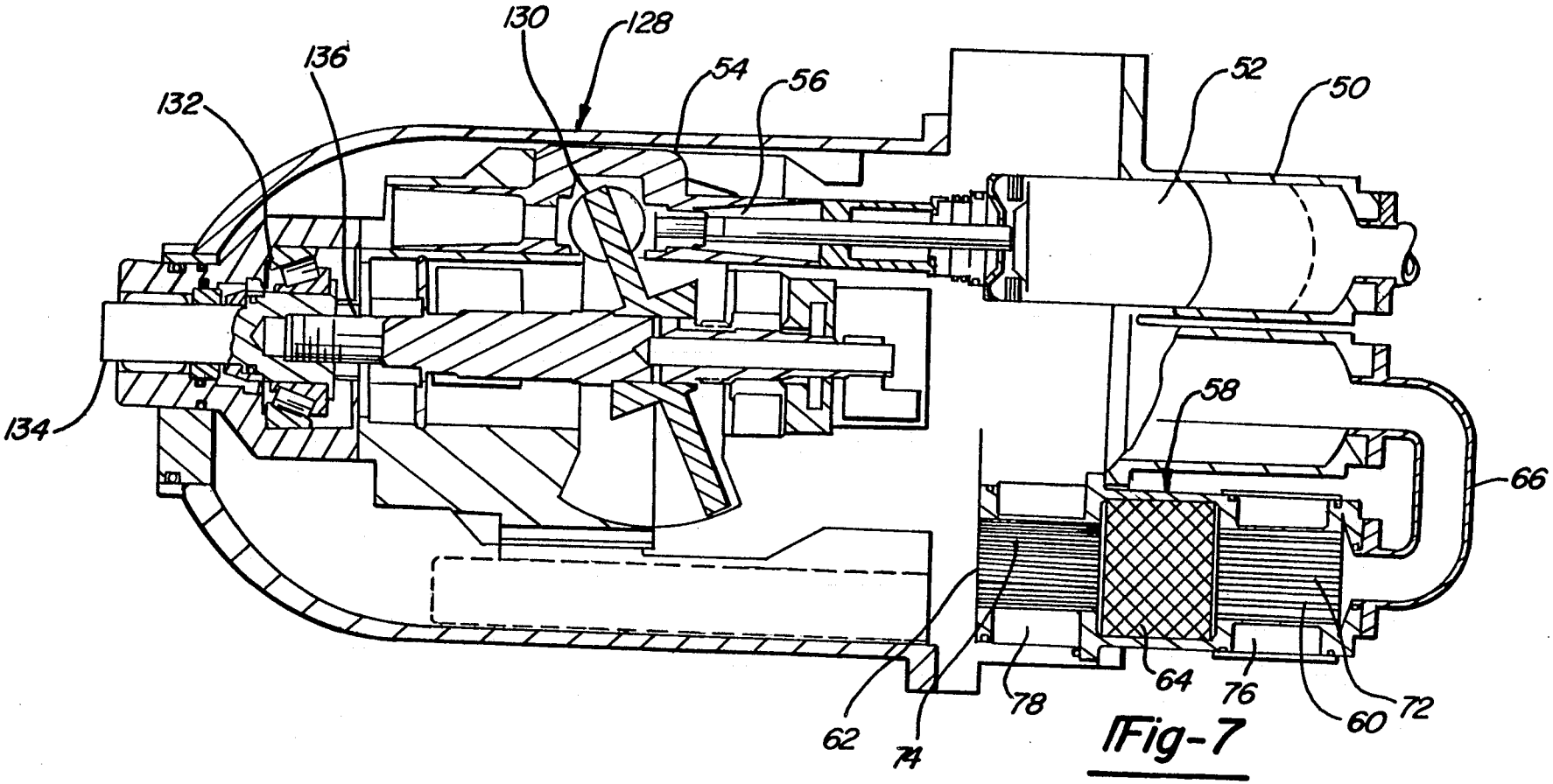
FIG. 7 is a cross-sectional view of a Stirling heat pump/air conditioner in accordance with a third embodiment of this invention adapted for external shaft drive and particularly adapted for automotive air conditioning/coolant heating applications.

Now with reference to FIG. 7, a third embodiment of a Stirling heat pump/air conditioner 128 is shown. This embodiment differs principally from the prior two embodiments in that it is an open drive machine particularly designed to be driven externally, for example, by a pulley driven off an automotive internal combustion engine. This embodiment uses piston and cylinder arrangements which are substantially identical to those described previously but sized appropriately for its application. The device shown in FIG. 7 does not include a variable angle swashplate mechanism but rather has a fixed stroke swashplate 130 since the device is intended for low cost automotive application. An input shaft decoupler is provided in the form of splined connections 132 to decouple wobbling of power input shaft 134 from swashplate shaft 136. When the device is used as an air conditioner, expansion space heat exchanger 60 is connected to a heat exchanger within the vehicle which absorbs heat and takes the place of a conventional Freon vapor compression system evaporator. Heat is rejected from the unit through a normal coolant fluid of a radiator through compression space heat exchanger 62. As explained in connection with FIG. 3, appropriate valves can be employed to switch the routing of fluids from compression space heat exchanger and expansion space heat exchanger to provide a heating function In the heating mode, the heat exchanger for compartment cooling would deliver heated air. Machine 128 can therefore be used to provide compartment heating immediately after engine start-up without awaiting the engine coolant temperature to increase. A safety enhancement is also contemplated when using such a system during winter months since windshield defrosting could be done immediately.

As stated previously, a number of improvements are incorporated into Stirling heat pump/air conditioning systems in accordance with this invention which enhance their capabilities and efficiencies. In the following description of the features of this invention, the following nomenclature and relationships will be used and referred to:

Nomenclature $Q_{ead}$ Energy (heat) needed in expansion side, adiabatic [kW]

$Q_{ef}$ Fluid friction loss in expansion side [kW]

$Q_{eloss}$ Sum of all other losses in expansion side [kW]

$Q_e$ Expansion energy after losses [kW]

$$Q_e = Q_{ead} - Q_{ef} - Q_{eloss}$$

$Q_{sad}$ Shaft power, adiabatic $Q_{sf}$ Fluid friction losses for shaft power $Q_{sloss}$ Sum of other losses for shaft power $Q_s$ Shaft power after cycle losses $$Q_s = Q_{sad} - Q_{sf} - Q_{sloss}$$

$Q_{smech}$ Mechanical losses due to drive on shaft power

COP Coefficient of Performance for cooling $$COP = \frac{Q_e}{Q_s - Q_{smech}}$$

$P_{max}$ Maximum cycle pressure in compression side $P_{min}$ Minimum cycle pressure in compression side $V_o$ Swept volume of piston K Gas constant (hydrogen 1.4; for helium 1.68)

$\epsilon$ Mathematical symbol to calculate pressure ratio

V Volume

D.V Dead volume

Subscripts

HCD Expansion connecting duct in expansion side

CCD Compression connecting duct in compression side

C Compression heat exchanger

R Regenerator

E Expansion heat exchanger

The "dead volume" of a Stirling machine can be defined as the total volume of the cycle which exceeds the displacement of the piston(s). Stirling engine designers attempt to maximize the machine's pressure ratio by minimizing the volumes of the aforementioned elements while maintaining acceptable flow losses and heat transfer capabilities through those elements. As dead space volume is decreased, the pressure ratio of the machine increases. A typical value of pressure ratio for a Stirling engine is on the order of 2.0 but may approach 1.6 in some designs. Decreases in pressure ratio from that level were previously seen to be undesirable since they would lead to decreases in thermal output for the device. These inventors have found, however, that deliberate increases in dead volume and a strategic positioning of the dead volume can be provided to enhance operational characteristics of a Stirling heat pump/air conditioning machine.

Figure 8:
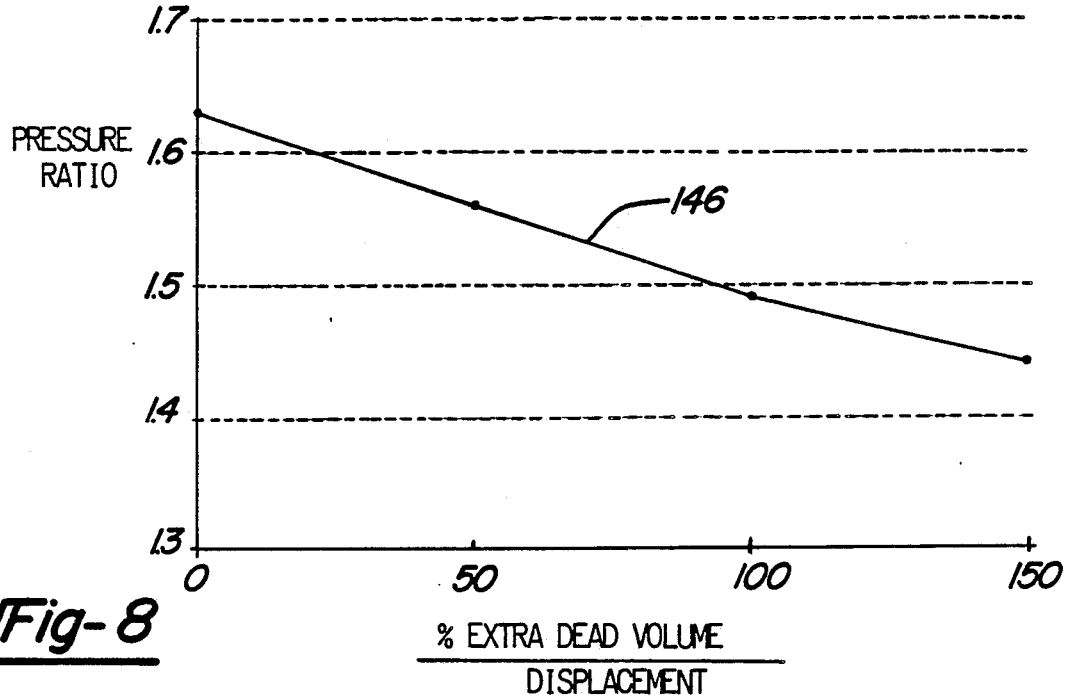
FIG. 8 is a graph showing the relationship between pressure ratio and percent extra dead volume for a Stirling machine.
Figure 9:
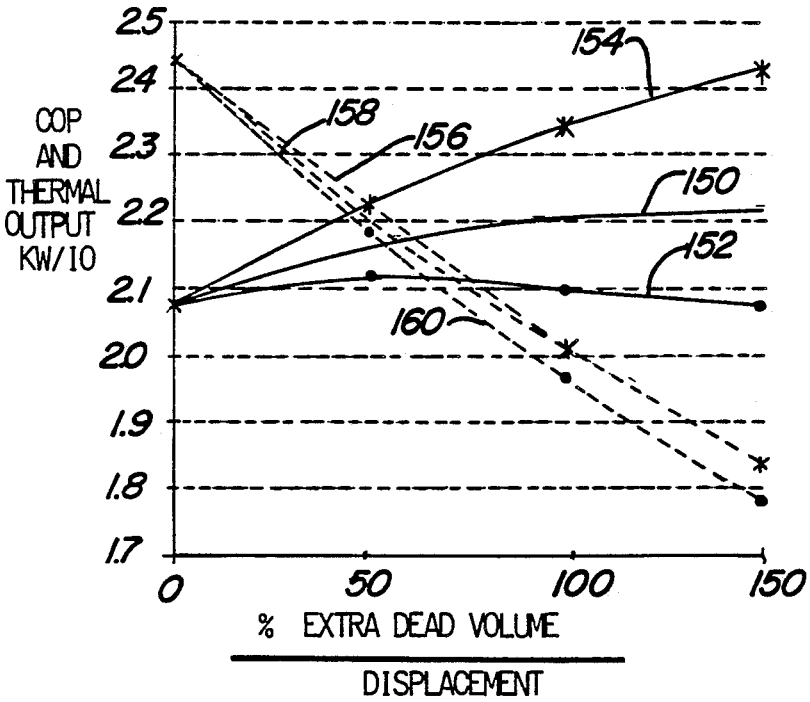
FIG. 9 is a graph showing the relationship between coefficient of performance and thermal energy output for a representative Stirling machine with respect to percent extra dead volume.

FIG. 8 is a graph relating pressure ratio to percent extra dead volume. The percent extra dead volume is calculated as the percent of swept volume over and above the dead volume that is provided for an optimized Stirling engine designed to produce mechanical output power. As shown, the pressure ratio of a Stirling engine is ordinarily above 1.6. Curve 146 of FIG. 8 shows how pressure ratio decreases as percent extra dead volume increases. FIG. 9 is a graph which relates percent extra dead volume as defined in FIG. 8, related to COP of the machine and its cooling output in kilowatts (note that kilowatts are divided by 10 so they can be plotted on the same scale as COP). These values are for a representative Stirling Thermal Motors machine having four cylinders with a 55 cc. displacement per cylinder. The full lines show COP effects when the extra dead volume is added to the expansion space connecting duct 66 at curve 150, the compression space connecting duct 68 at curve 152, and to the regenerator at curve 154. Note that in either of the three cases plotted in full lines, as percent extra dead volume is increased, COP increases. However, the increase is most striking in the case where the extra dead volumes is added to regenerator 64. In the case of adding the extra dead volume to the compression space connecting duct 68, once the percent extra dead volume exceeds 100% of displacement, a decrease in COP occurs.

The dashed lines in FIG. 9 illustrate the relationship between thermal air conditioning output and extra dead volume for a representative device having four cylinders with 55 cc. displacement each. As is seen, there is not a dramatic difference in thermal output as the extra dead volume is added in different areas. Curve 156 for adding the dead space in regenerator 64 has approximately the same behavior as curve 158 where the dead volume is added to the expansion space connecting duct 66 and is somewhat higher than that shown in curve 160 where the extra volume is added to the compression space connecting duct 68. FIG. 9 illustrates the advantages in terms of enhanced COP by adding extra dead volume to the regenerator where possible.

Figure 10:
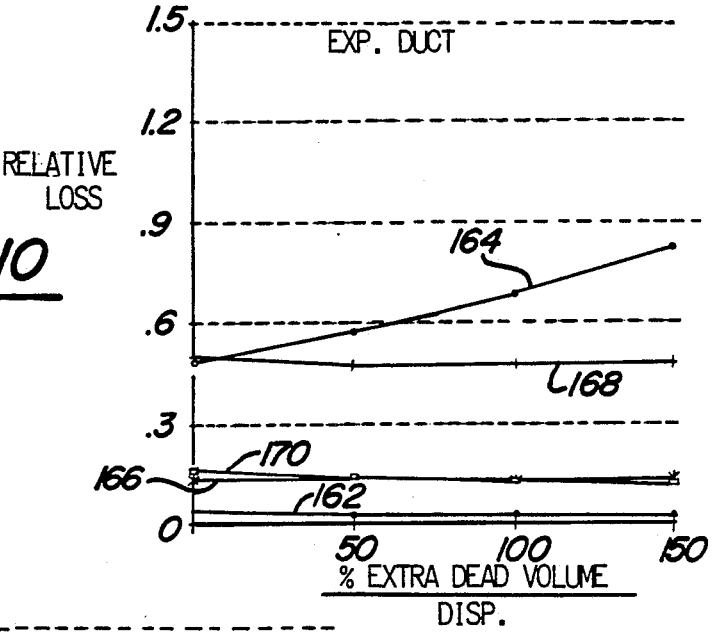
FIG. 10 is a graph showing the relationship between various losses when extra dead volume is added to the expansion space connecting duct.
Figure 11:
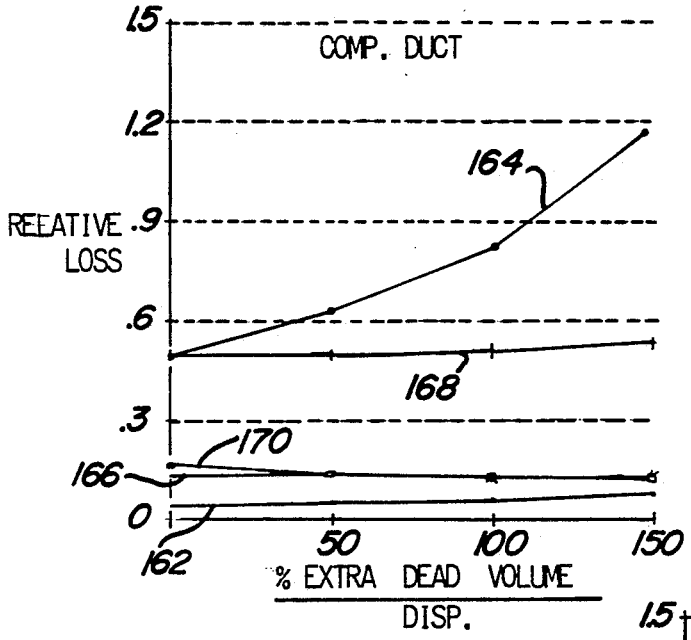
FIG. 11 is a graph showing the losses when extra dead volume is added to the compression space connecting duct.
Figure 12:
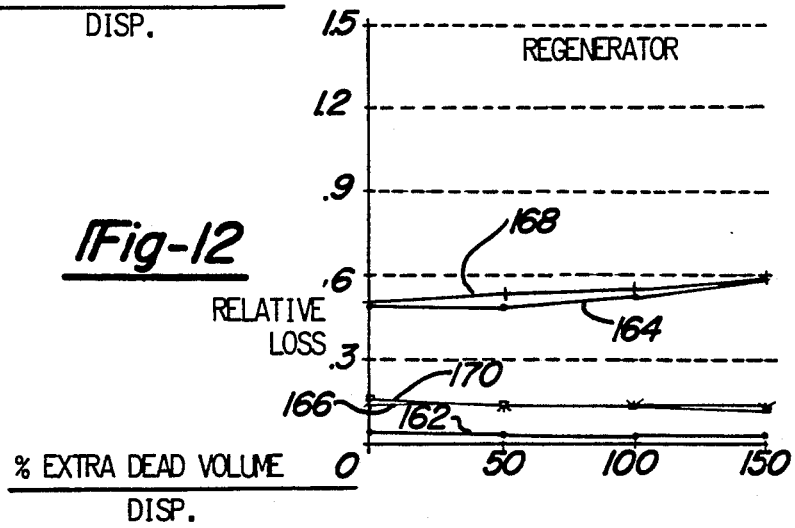
FIG. 12 is a graph showing the relationship between losses when extra dead volume is added to the regenerator of a Stirling machine.

FIGS. 10 through 12 depict the effects of changes on percent extra dead volume on various losses as the dead volume is added in the expansion space connecting duct, compression space conducting duct, and regenerator. For each of the figures, reference number 162 refers to curves describing the losses in fluid friction in the expansion space as defined by $Q_{ef}$ divided by $Q_{ead}$, curve 164 refers to fluid friction effect on the shaft power as defined by $Q_{sf}$ divided by $Q_{sad}$, curve 166 relates to the sum of all other (than fluid friction) losses in the expansion side as defined by $Q_{eloss}$ divided by $Q_{ead}$, curve 168 describes the total of all other (than fluid friction) shaft power losses defined by $Q_{sloss}$ divided by $Q_{sad}$ and curve 170 refers to adiabatic shaft power as defined by $Q_{sad}$ divided by $Q_{ead}$. As can be seen from FIG. 8 which describes adding dead space volume to the expansion space connecting duct 66, losses remain fairly constant with the exception of shaft power fluid friction losses which increase significantly with increasing dead volume. FIG. 11 shows a consistent characteristic when extra dead space is added to the compression space connecting duct where shaft power losses also increase significantly with increases in dead volume. On the other hand, as shown in FIG. 12, losses remain generally constant with increasing amount of dead volume when that dead volume is added to the regenerator, thus graphically illustrating the benefits of adding dead volume to the regenerator as opposed to other regions of the Stirling machine.

While the above description constitutes the preferred embodiments of the present invention, it will be appreciated that the invention is susceptible of modification, variation and change without departing from the proper scope and fair meaning of the accompanying claims.

We claim:

1. A duplex Stirling cycle machine acting as a heat pump comprising:

a Stirling engine having a plurality of pistons axially displaceable within parallel cylinders, said engine further having a swashplate rotatable about an axis of, rotation parallel to said cylinders and defining a plane inclined from said axis of rotation, said pistons connected to said swashplate via crossheads whereby axial displacement of said pistons is converted to rotation of said swashplate, and a Stirling cycle heat pump having a compression heat exchanger, an expansion heat exchanger and a regenerator with a plurality of pistons equal in number to said engine pistons and axially displaceable within cylinders which are oriented co-axially with said engine cylinders, said crossheads further connected to said heat pump pistons whereby said heat pump pistons move simultaneously with said engine pistons over an equal stroke distance.

2. A duplex Stirling cycle machine as set forth in claim 1 wherein said Stirling engine uses a working fluid at a predetermined average pressure within said engine and said Stirling cycle heat pump having the same working fluid at the same average pressure as said engine.

3. A duplex Stirling cycle machine as set forth in claim 2 wherein said machine employs helium as a working fluid.

4. A duplex Stirling cycle machine as set forth in claim 2 wherein said machine employs hydrogen as a working fluid.

5. A duplex Stirling cycle machine as set forth in claim 2 wherein said working fluid is charged to a pressure of greater than 40 atmospheres.

6. A duplex Stirling cycle machine as set forth in claim 2 wherein said working fluid is charged to a pressure of about 110 atmospheres.

7. A duplex Stirling cycle machine as set forth in claim 1 wherein said Stirling engine receives heat input through combustion of a fuel.

8. A duplex Stirling cycle machine as set forth in claim 1 wherein said compression heat exchanger thermally communicates with a heat transfer coil situated within a volume to be heated and said expansion heat exchanger thermally communicates with a heat transfer coil situated in an external environment.

9. A duplex Stirling cycle machine as set forth in claim 1 wherein said Stirling cycle machine further functions as an air conditioner in which said expansion heat exchanger thermally communicates with a heat transfer coil situated within a volume to be cooled and said compression heat exchanger thermally communicates with an external environment.

10. A duplex Stirling cycle machine as set forth in claim 1 further comprising a variable stroke swashplate mechanism enabling the angle of inclination of said swashplate with respect to said axis of rotation to be varied whereby the stroke of said engine and heat pump pistons can be adjusted to match various load conditions.

11. A duplex Stirling cycle machine as set forth in claim 1 wherein said heat pump pistons have a greater swept volume as compared with said engine pistons.

12. A duplex Stirling cycle machine as set forth in claim 1 wherein said expansion heat exchanger is located further from said swashplate than said compression heat exchanger.

13. A duplex Stirling cycle machine as set forth in claim 1 further comprising an electric motor for driving said swashplate or to generate electricity.

14. A duplex Stirling cycle machine as set forth in claim 1 further comprising an auxiliary power take-off shaft coupled to said swashplate.

15. A Stirling cycle heat pump for converting mechanical input energy to a thermal output comprising:

at least one piston reciprocally movable in a cylinder wherein one end of said cylinder communicating with an expansion heat exchanger and the opposing end of said cylinder communicating with a compression heat exchanger with a regenerator between said expansion and said compression heat exchangers, wherein said heat pump is charged with a working gas which undergoes pressure changes in said expansion and said compression heat exchangers upon reciprocation of said piston characterized by a ratio of maximum pressure in said compression heat exchanger to minimum pressure in said compression heat exchanger of equal to or less than 1.5.

16. A Stirling cycle heat pump as set forth in claim 15 wherein said compression heat exchanger thermally communicates with a heat transfer coil situated within a volume to be heated and said expansion heat exchanger thermally communicates with a heat transfer coil situated in an external environment.

17. A Stirling cycle heat pump as set forth in claim 15 wherein said Stirling cycle machine further functions as an air conditioner in which said expansion heat exchanger thermally communicates with a heat transfer coil situated within a volume to be cooled and said compression heat exchanger thermally communicates with an external environment.

18. A Stirling cycle heat pump as set forth in claim 15 wherein said heat pump is driven by a Stirling engine having a plurality of pistons reciprocally movable in parallel cylinders, said engine further having a swashplate rotatable about an axis of rotation parallel to said cylinders, said swashplate defining a plane inclined from said axis of rotation, a plurality of crossheads connected to said engine pistons which engage said swashplate to rotate said swashplate in response to axial displacement of said engine pistons, said heat pump having a plurality of pistons equal in number to said engine pistons and axially movable within cylinders coaxial with said engine cylinders and connected to said crossheads to move axially simultaneous with and through the same stroke distance as said engine pistons.

19. A Stirling cycle heat pump as set forth in claim 18 wherein said Stirling engine uses a working fluid at a predetermined average pressure within said engine and said Stirling cycle heat pump having the same working fluid at the same average pressure as said engine.

20. A Stirling cycle heat pump as set forth in claim 18 wherein the pressure ratio of said heat pump is less than that of said engine.

21. A Stirling cycle heat pump as set forth in claim 18 wherein said machine employs helium as a working fluid.

22. A Stirling cycle heat pump as set forth in claim 18 wherein said machine employs hydrogen as a working fluid.

23. A Stirling cycle heat pump as set forth in claim 18 wherein said working fluid is charged to a pressure of greater than 40 atmosphere.

24. A Stirling cycle heat pump as set forth in claim 18 wherein said working fluid is charged to a pressure of about 110 atmospheres.

25. A Stirling cycle heat pump as set forth in claim 18 wherein said Stirling engine receives heat input through combustion of a fuel.

26. A Stirling cycle heat pump as set forth in claim 18 wherein said heat pump pistons have a greater swept volume as compared with said engine pistons.

27. A Stirling cycle heat pump as set forth in claim 18 wherein said expansion heat exchanger is located further from said swashplate than said compression heat exchanger.

28. A Stirling cycle heat pump as set forth in claim 18 further comprising an electric motor for driving said swashplate or to generate electricity.

29. A Stirling cycle heat pump as set forth in claim 18 further comprising an auxiliary power take-off shaft coupled to said swashplate.

30. A Stirling cycle heat pump as set forth in claim 15 further comprising means for varying the stroke of said piston and wherein said pressure ratio is equal to or less than 1.5 when said pistons are at a maximum stroke and decreases as said stroke decreases.

31. A Stirling cycle heat pump as set forth in claim 15 wherein said heat pump is driven by an electric motor.

32. A Stirling cycle heat pump as set forth in claim 31 wherein said electric motor is enclosed within a pressure hull in which said motor is surrounded by a working fluid for said Stirling cycle heat pump.

33. A Stirling cycle heat pump as set forth in claim 15 wherein said heat pump is used as an air conditioner for a motor vehicle wherein said pistons are driven by the engine of said motor vehicle.

34. A Stirling cycle heat pump as set forth in claim 33 wherein said heat pump is enclosed by a pressure hull and a shaft penetrates said pressure hull allowing mechanical energy to be imparted to said pistons from a source external to said pressure hull.

35. A Stirling machine for air conditioning and coolant heating for a motor vehicle comprising:

at least one piston reciprocatable in a cylinder wherein one end of said cylinder communicating with a compression heat exchanger and the opposing end of said cylinder communicating with a expansion heat exchanger with a regenerator between said heat exchangers, a first heat transfer coil for changing the temperature of air within the interior compartment of said vehicle, a second heat transfer coil outside of said interior compartment, and valve means for controlling the flow of fluids between said heat exchangers and said heat transfer coils such that in a first mode, said expansion heat exchanger is connected to said first heat transfer coil and said compression heat exchanger is connected to said second heat transfer coil thereby cooling said vehicle compartment, and in a second mode of operation, said expansion heat exchanger is connected to said second heat transfer coil and said compression heat exchanger is connected to said first heat transfer coil thereby warming said vehicle compartment.

* * * * *